US007387109B2

(12) United States Patent
Rembold et al.

(10) Patent No.: US 7,387,109 B2
(45) Date of Patent: Jun. 17, 2008

(54) HIGH-PRESSURE FUEL PUMP FOR AN INTERNAL COMBUSTION ENGINE

(75) Inventors: Helmut Rembold, Stuttgart (DE); Ruediger Schnell, Eberbach (DE); Bernd Schroeder, Esslingen (DE)

(73) Assignee: Robert Bosch GmbH, Stuttgart (DE)

( * ) Notice: Subject to any disclaimer, the term of this patent is extended or adjusted under 35 U.S.C. 154(b) by 210 days.

(21) Appl. No.: 10/968,962

(22) Filed: Oct. 21, 2004

(65) Prior Publication Data

US 2005/0115543 A1 Jun. 2, 2005

(30) Foreign Application Priority Data

Oct. 21, 2003 (DE) ..... 103 48 771
Jun. 12, 2004 (DE) ..... 10 2004 028 615

(51) Int. Cl.
*F02M 37/04* (2006.01)

(52) U.S. Cl. ..... 123/446; 123/458; 137/513.5

(58) Field of Classification Search ..... 123/446, 123/456, 514, 467, 458; 137/513.5; 251/359
See application file for complete search history.

(56) References Cited

U.S. PATENT DOCUMENTS 2,057,624 A * 10/1936 Burkhart ..... 417/471
4,884,545 A * 12/1989 Mathis ..... 123/447
5,189,877 A * 3/1993 Wells et al. ..... 60/293
5,323,809 A * 6/1994 Tischer et al. ..... 137/596.17
5,895,208 A * 4/1999 Riedlinger et al. ..... 417/571
6,058,912 A * 5/2000 Rembold et al. ..... 123/516
6,446,606 B1 * 9/2002 Krimmer et al. ..... 123/458
6,626,151 B2 * 9/2003 Boehm et al. ..... 123/458
6,840,223 B2 * 1/2005 Fukuhara ..... 123/458
6,959,694 B2 * 11/2005 Kieferle et al. ..... 123/446
7,007,708 B2 * 3/2006 Burke et al. ..... 137/12
2003/0037769 A1 * 2/2003 Frenz et al. ..... 123/446
2003/0213471 A1 * 11/2003 Kieferle et al. ..... 123/447

* cited by examiner

*Primary Examiner*—Carl S Miller
(74) *Attorney, Agent, or Firm*—Ronald E. Greigg

(57) ABSTRACT

A high-pressure fuel pump for an internal combustion engine is proposed, in which the regulating behavior in idling and lower partial-load operation is improved to such an extent that a separate pressure regulating valve in the high-pressure region of the fuel injection system can be dispensed with.

12 Claims, 8 Drawing Sheets

HIGH-PRESSURE FUEL PUMP FOR AN INTERNAL COMBUSTION ENGINE

BACKGROUND OF THE INVENTION

1. Field of the Invention

The invention relates to an improved high-pressure fuel pump for an internal combustion engine.

2. Description of the Prior Art

As general prior art in this field, German Patent Disclosures DE 102 36 314 A1 and DE 198 53 103 A1 are cited.

The invention is based especially on a so-called common rail system (CR system). The special feature of such CR systems is that the fuel quantity needed for injection must be brought to a variable pressure, dependent on the operating state of the engine at the time, by a high-pressure fuel pump. The high-pressure fuel pump is driven as a function of engine rpm, which can be done for example by means of the engine camshafts. The possible supply quantity of the high-pressure fuel pump is designed such that excess fuel, that is, more than the rail needs for the desired pressure buildup, can be pumped in every operating state.

From DE 198 53 103 A1, a fuel metering unit is known in which the flow quantity is controlled by a valve piston. For controlling the flow rate, the valve piston partially or entirely uncovers one or more control openings.

In this fuel metering unit, which is embodied as a slide valve, leakage, also called leak fuel, occurs in the overrunning mode of the engine, that is, when the high-pressure fuel pump is not supposed to pump any fuel, during the intake phase of the pump elements of the high-pressure fuel pump, and as a result in an unwanted way the high-pressure fuel pump aspirates fuel. This fuel is then put at high pressure in the ensuing working stroke and is pumped into the common rail. A pressure buildup, which is unwanted in the overrunning mode of the engine, occurs there and is reduced or limited by a pressure regulating or pressure limiting valve that is triggered by the control unit of the injection system. Since the fuel metering unit must be triggered by the control unit of the injection system, and in normal operation the regulation of the supply quantity of the high-pressure fuel pump is effected solely via the fuel metering unit, in this fuel injection system there are two structural groups, namely the pressure limiting valve and the fuel metering unit, that must be triggered by the control unit.

OBJECT AND SUMMARY OF THE INVENTION

In a high-pressure fuel pump for an internal combustion engine, having at least one pump element for pumping fuel from an intake side to a compression side of the high-pressure fuel pump, having an device on the intake side for controlling the supply quantity of the high-pressure fuel pump, and having a first check valve disposed on the intake side and a second check valve disposed on the compression side, a relief device is provided according to the invention, which—counter to the flow direction of the first check valve—enables an at least partial pressure equilibrium between the inlet and outlet of the first check valve.

With this provision it is possible, for instance in the overrunning mode of the engine, to prevent an unwanted pressure buildup during the supply stroke into the pumping chambers of the pump elements, so that no fuel is pumped into the common rail. As a consequence, the pressure in the common rail does not increase, either, and the unwanted pressure increase in the common rail is reliably prevented.

It is therefore possible to dispense with a pressure regulating valve triggered by the control unit. A simple pressure limiting valve suffices.

Moreover, after the end of the overrunning, because the pressure has not risen in the common rail, it is also possible for an extremely small fuel quantity to be injected into the combustion chambers of the engine at low rail pressure, making a gentle transition from overrunning to normal operation of the engine possible.

Because of the provision proposed by the invention, it is additionally possible to expand the supply quantity regulation of the high-pressure fuel pump to lesser supply quantities, since the leakage that occurs for instance during engine idling in the fuel metering unit is not pumped into the common rail but instead is pumped back to the intake side of the high-pressure fuel pump by the relief device during the intake stroke of the pump elements. This is of major significance because the fuel leaking from a fuel metering unit may be on the same order of magnitude as the fuel quantity injected during idling. This means that without the provision according to the invention, in some unfavorable configurations, satisfactory idling regulation of the engine is impossible. By the provision proposed by the invention, it is reliably assured in all operating states that the supply quantity of the high-pressure fuel pump can be adapted to the fuel demand of the engine.

In a first variant embodiment, it is provided that the relief device includes a first bypass line, connecting an inlet and outlet of the first check valve, with a first throttle restriction. It is thus possible in a simple way for the leakage that occurs in idling or overrunning of the engine in the fuel metering unit, which leakage is aspirated during the intake stroke of the pump element, to be thrust back to the intake side of the high-pressure fuel pump in the ensuing supply stroke of the pump element.

Alternatively, the relief device may also be integrated with the first check valve. This can for instance be done by embodying the first check valve as a seat valve and providing a notch that has the function of a throttle restriction. The notch may have a rectangular, half-round or oval cross section and may be produced for instance by electrochemical machining or by creative shaping, in particular embossing. This variant embodiment is very simple to produce and very robust in operation and can easily be retrofitted in fuel injection systems already in mass production, whose first check valve is embodied as a seat valve.

In particular, it has proved advantageous if the first check valve has a counterpart plate with a valve seat and has a valve member cooperating with the valve seat, and the notch is provided between the valve seat and the valve member, in particular in the counterpart plate.

Alternatively, the relief device of the invention may also be furnished by providing that a fuel metering unit serves as the device on the intake side for controlling the supply quantity of the high-pressure fuel pump; that the fuel metering unit has a regulating valve, actuated by an electromagnet by means of an armature bolt, with a valve piston; and that the first check valve can be opened by the armature bolt.

By this provision, the functionality of the fuel metering unit can be expanded without additional effort or expense. Specifically, as is known in the prior art, the fuel metering unit is responsible, during normal engine operation, for regulating the supply quantity of the high-pressure fuel pump. If the supply quantity of the high-pressure fuel pump is to be reduced further than the leak fuel quantity of the fuel metering unit, then the supply quantity of the high-pressure fuel pump can be reduced further by triggering the first check valve during the supply stroke of the pump element, with the aid of the fuel metering unit. Particularly in engine overrunning, it can as a result be reliably assured that no fuel will be pumped into the common rail, and thus no pressure increase occurs in the common rail.

For the case where the metering unit sticks in the open position, however, it is recommended that a pressure limiting valve be provided on the common rail that need not be triggered by the control unit but instead is controlled directly via the pressure in the common rail.

It has also proved advantageous if the valve piston of the fuel metering unit is guided in a valve housing, and at least one and preferably a plurality of radial control openings are disposed in the wall of the valve housing, and the first check valve is not opened by the armature bolt until the control openings are closed.

In this exemplary embodiment, care must be taken in particular to assure that the valve piston is fitted into the valve housing with only very slight play, so that the leak fuel quantity is as slight as possible. In that case, it is merely necessary from time to time, during idling, to open the first check valve, in order to prevent the pressure increase in the common rail from fuel pumped unintentionally.

To assure that the fuel metering unit will operate independently of the position of the valve piston in the valve housing, the valve piston has a turned recess on its cylindrical circumferential surface, and a radial bore communicating with the intake side of the high-pressure fuel pump is disposed in the valve housing in such a way that the control openings can be made to communicate with the radial bore in the valve housing through the turned recess in the valve piston.

In a further augmentation of the invention, it is provided that a second bypass line, connecting the interior of the regulating valve and the intake side of the high-pressure fuel pump, is provided with a second pressure limiting valve. The opening pressure of the second pressure limiting valve may for instance be 0.3 bar, so that high pressures in the pumping chamber of the pump elements and in the fuel metering unit are avoided when the leak fuel is expelled to the intake side of the high-pressure fuel pump.

In a further advantageous feature of the invention, a second bypass line, connecting the inlet and outlet of the device for controlling the supply quantity, is provided that has a second pressure limiting valve. This device makes it possible, above all in conjunction with the inlet valve control by the armature bolt of the fuel metering unit, to maintain a specified pressure level in the interior of the fuel metering unit.

In conjunction with a third bypass line, which connects the inlet and outlet of the second check valve and has a second throttle restriction, a targeted pressure reduction in the rail can be effected during engine overrunning. As a result, the injection of the initially small fuel injection quantities at the transition from overrunning to normal operation can be done from a lower pressure level in the common rail, which improves the metering precision of the fuel injection.

In a further advantageous feature of the high-pressure fuel pump of the invention, a third pressure limiting valve and a third check valve are provided hydraulically in line with the second throttle restriction. This third pressure limiting valve has an opening pressure of 5 to 10 MPa, for instance, which is approximately equivalent to the pressure level in high-pressure starting of the engine. The advantage of this embodiment is that the pressure reduction function is not operative during the high-pressure start, and thus the volumetric efficiency of the high-pressure fuel pump is markedly improved.

If the high-pressure fuel pump has a plurality of pump elements, it suffices to trigger the first check valve of a pump element as described above, or to provide a pressure compensation device on a pump element.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
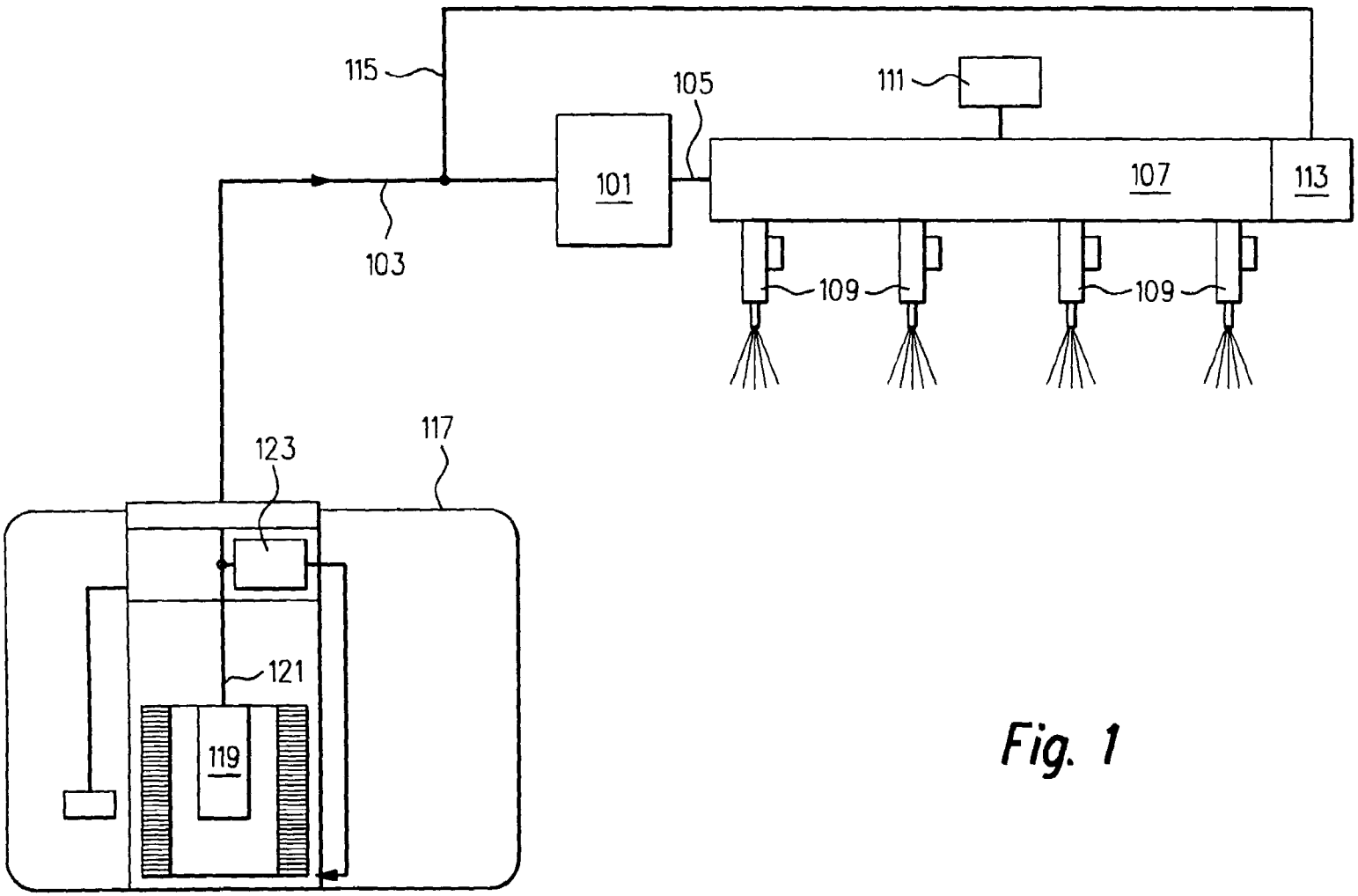
FIG. 1 is a block circuit diagram of an injection system.

In FIG. 1, an injection system, as an example, is shown in the form of a block circuit diagram, but the invention is not limited to this injection system. A high-pressure fuel pump 101 according to the invention has an intake side 103 and a compression side 105. On the compression side, both a common rail 107 and a plurality of injectors 109 are connected to the high-pressure fuel pump 101. Both a pressure sensor 111 and a first pressure limiting valve 113 are disposed on the common rail 107. From the first pressure limiting valve 113, a connecting line 115 leads to the intake side 103 of the high-pressure fuel pump 101.

The intake side 103 of the high-pressure fuel pump 101 communicates with a low-pressure pump 119, disposed in a tank 117. The low-pressure pump 119 may for instance be an electric fuel pump. Between a compression side 121 of the low-pressure pump 119 and the intake side 103 of the high-pressure fuel pump 101, a pressure regulating valve 123 is disposed in the tank 117. The pressure regulating valve 123 assures that the pressure on the intake side 103 of the high-pressure fuel pump 101 is kept virtually constant during engine operation. Typically, the pressure on the intake side 103 is between 3 and 6 bar.

The pressure limiting valve 113 prevents excessively high pressures in the common rail 107 and is triggered directly (not shown) via the pressure in the common rail 107.

Figure 2:
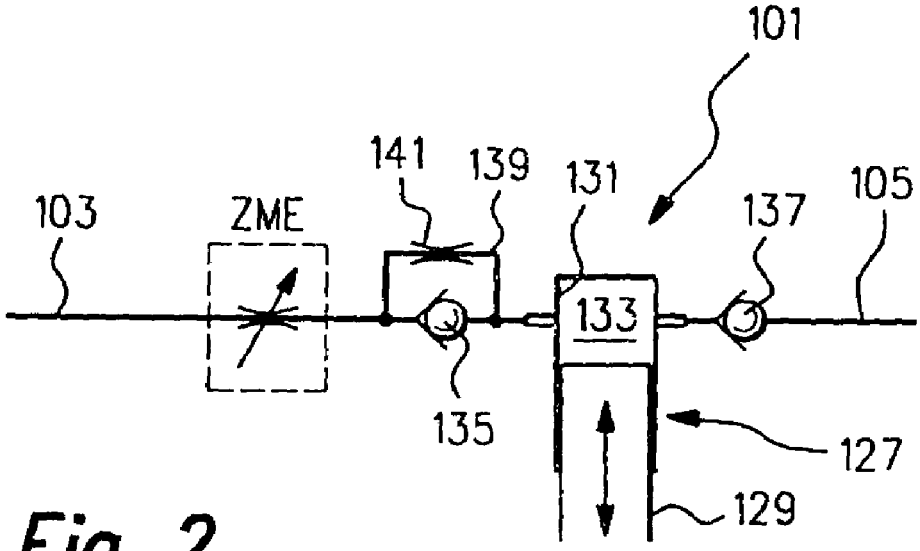
FIGS. 2-4, 6, 8 and 9 show exemplary embodiments of high-pressure fuel pumps of the invention.

In FIG. 2, a first exemplary embodiment of a high-pressure fuel pump 101 of the invention is shown schematically. In this exemplary embodiment, the high-pressure fuel pump comprises a pump element 127, which has a piston 129, a cylinder bore 131, and a pumping chamber 133 defined by the piston 129 and the cylinder bore 131.

On the intake side 103, which connects the high-pressure fuel pump 101 to the tank 117 (see FIG. 1), a fuel metering unit ZME and a first check valve 135 are connected in series.

The piston 129 executes an oscillating motion, which is represented in FIG. 2 by a double arrow. During the intake stroke, the piston 129 moves from top to bottom in terms of FIG. 2; that is, a volume of the pumping chamber 133 increases. During this intake stroke, the piston 129 aspirates fuel from the intake side 103 into the pumping chamber 133, through the metering unit ZME and the first check valve 135. In the ensuing supply stroke, when the piston 129 moves from its bottom dead center to its top dead center, the volume in the pumping chamber 133 decreases; the fuel located in the pumping chamber 133 is put under pressure, until finally, through a second check valve 137, it is expelled to the supply side 105 and then into the common rail 107 (see FIG. 1).

The metering unit ZME is embodied as a slide valve and serves to regulate the fuel quantity aspirated during the intake stroke. As a rule, it is embodied as a proportional valve, with continuously variable adjustment of its cross section.

If during engine idling, for instance (not shown), only a very slight fuel quantity is to be aspirated into the pumping chamber 133, then leakage occurs at the fuel metering unit ZME, as is true of any slide valve. This means that fuel passes uncontrollably from the intake side 103 into the pumping chamber 133, bypassing the control openings of the fuel metering unit ZME. Since this leakage is approximately as great in volume as the quantity of fuel pumped by the high-pressure fuel pump 101 during engine idling, the engine idling cannot be regulated with sufficient precision.

In engine overrunning, when no fuel is supposed to be injected, the leakage in the fuel metering unit ZME of the prior art causes fuel to be pumped via the compression side 105 into the common rail 107, without fuel being injected from the injectors 109 into the combustion chambers of the engine. As a consequence, the pressure in the common rail 107 rises, until after an allowable maximum pressure is reached the first pressure limiting valve 113 opens and limits the pressure in the common rail 107 to the maximum allowable value.

If a change is to be made from overrunning to normal operation, it is desirable as a rule to have a low pressure in the common rail, since it is then more easily possible, in the transition phase from overrunning to normal operation, to inject extremely small quantities of fuel and thus to achieve a gentle transition between these two operating states of the engine.

This high pressure in the common rail 107 makes it difficult to inject extremely small fuel quantities, so that the pressure increase in overrunning caused by the leakage from the fuel metering unit ZME is also unwanted.

In a first embodiment of a high-pressure fuel pump 101 according to the invention, a first bypass line 139 with a first throttle restriction 141 is provided, which bypasses the first check valve 135. The flow resistance of the first throttle restriction 141 is selected such that at partial load and full load of the engine, the fuel quantity returned to the intake side 103 by the first throttle restriction 141 is negligible, compared to the fuel quantity pumped into the compression side 105.

In engine idling, the fuel quantity pumped by the piston 129 is split between the compression side 105 and the intake side 103 in such a way that the fuel quantity to be injected is pumped into the compression side 105, while a fuel quantity corresponding to the leak fuel quantity from the fuel metering unit ZME is pumped back into the suction line 103. Thus it is possible to regulate the supply quantities of the high-pressure fuel pump 101 in engine idling as well, despite the leakage occurring in the fuel metering unit ZME.

In overrunning as well, when no fuel is to be injected into the combustion chambers of the engine, the leak fuel quantity of the fuel metering unit ZME can be returned into the suction line during the supply stroke of the piston 129, via the first bypass line 139 and the first throttle restriction 141, bypassing the first check valve 135. As a result, the unwanted pressure increase in the common rail 107 is prevented effectively and in the simplest possible way.

Figure 3:
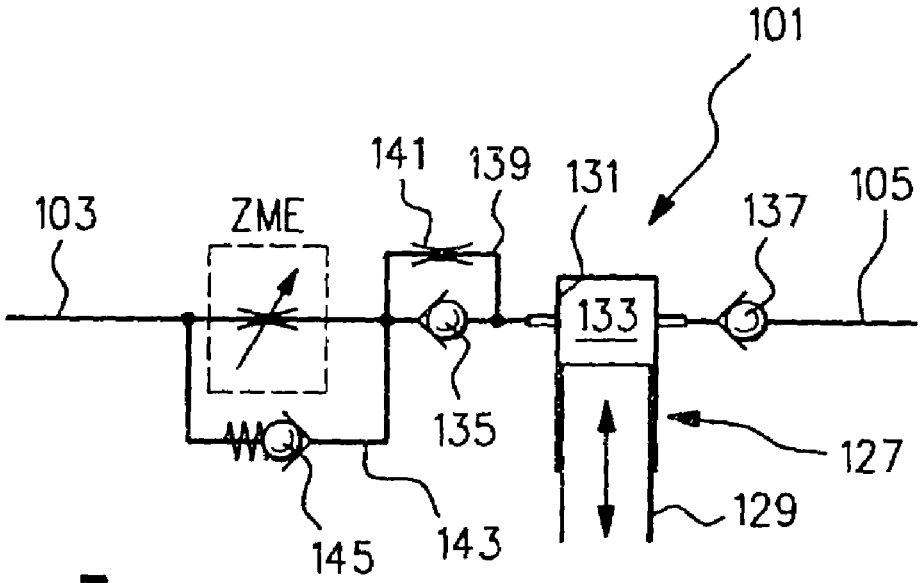

In the exemplary embodiment of FIG. 3, the operation of the high-pressure fuel pump of the invention is further improved by the provision of a second bypass line 143 having a second pressure limiting valve 145, which bypass the fuel metering unit ZME.

The second pressure limiting valve 145 has a relatively low opening pressure, for instance of 0.3 bar. As a result, the leak fuel quantity that is returned from the pumping chamber 133 into the suction line 103 is not pumped through the fuel metering unit, with its relatively high flow resistance in the closed state, but rather via the second bypass line 143. As a result, the load on the pump element 127 in idling decreases, and the pressure loads in the fuel metering unit ZME and in the pump element 127 are reduced.

The pressure regulation in the common rail 107 in high-pressure starting is effected via the fuel metering unit ZME.

Figure 4:
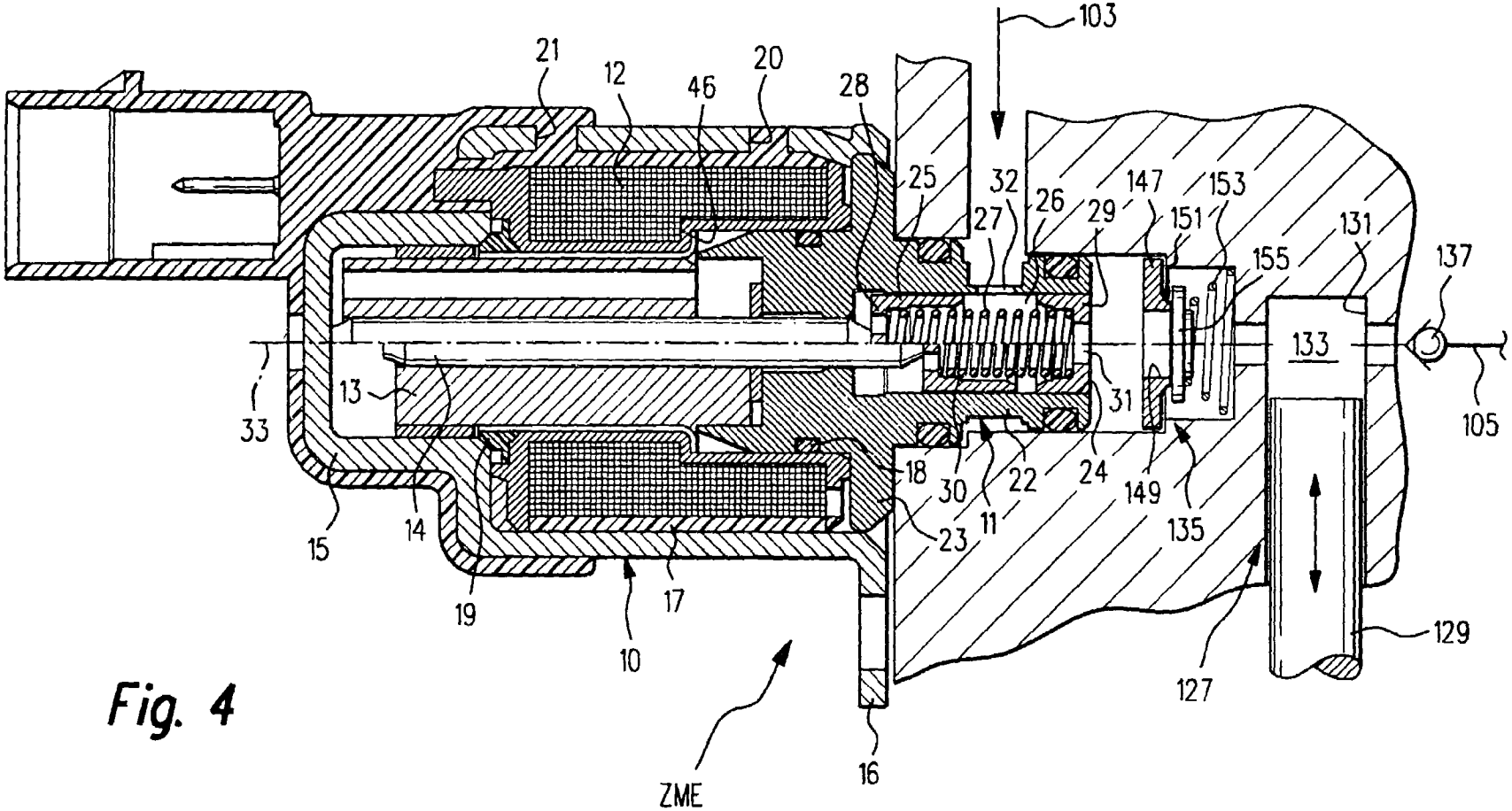

The fuel metering unit ZME of FIG. 4 is based on an electromagnet 10 with an integrated regulating valve 11. In detail, the electromagnet 10 essentially comprises a magnet coil 12, an armature 13 with an armature bolt 14, and a magnet cup 15 that partly surrounds the magnet coil 12 and the armature 13.

The entire structural unit of the electromagnet 10, with the integrated regulating valve 11, is disposed in a high-pressure fuel pump 101. The magnet cup 15 acts simultaneously here as a sealing element, a magnetic short circuit, and a securing element 16 of the electromagnet 10 in the high-pressure fuel pump.

Once the magnet coil 12 is inserted into the magnet cup 15, it is spray-coated on all sides. The spray coating 17 assures an optimal heat transfer from the coil 12 to the magnet cup 15. Overheating in critical operating states can be counteracted as a result. Moreover, the spray coating 17 leads to good resistance to vibration and jarring, making it possible for the fuel metering unit ZME to be secured to points, for instance on the high-pressure fuel pump, that are heavily loaded with respect to vibration, temperature, and environmental factors.

Moreover, the spray coating 17 of the magnet coil 12 in cooperation with two sealing points 18, 19 assures that the contact points of the coil 12 with the plug lugs (not shown) are "dry". The magnet coil winding and contact points are thus optimally protected against the attack of corrosive media.

To check that the spray coating 17 completely surrounds the magnet coil 12, "overflow bores" 20, 21 are provided on the circumference of the magnet cup 15.

The regulating valve 11 has a valve housing 22, which changes into a flangelike widened portion 23 that at the same time forms the termination on the face end of the magnet cup 15. An axial bore 24 is embodied in the valve housing 22 and is disposed coaxially to the armature bolt 14 of the electromagnet 10. The axial bore 24 receives a displaceable, sleevelike valve piston 25, in the interior 26 of which a compression spring 27 is disposed. The compression spring 27 is braced on the front end on a bottom 28 of the valve piston 28 and on the back on a spring plate 29 that is located in the axial bore 24 of the valve housing 22. A shoulder 30 on the inner wall of the valve piston 25 assures that the compression spring 27 rests in the valve piston 25 largely without contact with the inner wall. On the outside, the valve piston bottom 28 and thus the valve piston 25 are in contact with the front end of the armature bolt 14.

A plurality of radially oriented control openings, of which in FIG. 4 only one is visible and is identified with reference numeral 32, are disposed in the valve housing 22. The control openings 32 are in hydraulic operative communication with the intake side 103 of the high-pressure fuel pump 101. Accordingly, the intake side 103 forms the inlet to the fuel metering unit ZME.

An opening 31 connects the interior 26 of the valve piston 25 to the first check valve 135, which in this exemplary embodiment is embodied as a seat valve.

The upper half of FIG. 4—above the common center axis 33 of the valve bore 24, valve piston 25, and armature bolt 14—shows the regulating valve 11 in the open position, in which the control opening 32 is completely uncovered by the valve piston 25. Conversely, in the lower half of FIG. 4, the regulating valve 11 is shown in the completely closed position. The magnetic force of the electromagnet 10, when it is supplied with current, acts via the armature bolt 14 on the valve piston 25 and moves it, counter to the resistance of the compression spring 27, into the aforementioned closed position of the regulating valve 11. Conversely, the compression spring 27 is capable of displacing the valve piston 25 into the open position (upper half of FIG. 4) when the supply of current to the electromagnet 10, and hence its magnetic force acting on the armature 13 and the armature bolt 14, is reduced accordingly.

In the open position of the regulating valve 11, the fuel supplied to the regulating valve 11 from the intake side 103 and through the control opening 32, flows through the opening 31 to the first check valve 135 into the pumping chamber 133 of the pump element 127.

The first check valve 135, in the exemplary embodiment of FIG. 4, comprises a counterpart plate 147 with a bore 149 and with a valve seat 151. By means of a second compression spring 153, which is braced on one end on the housing of the high-pressure fuel pump 101, a valve member 155 is pressed against the valve seat 151 of the counterpart plate 147.

Figure 5:
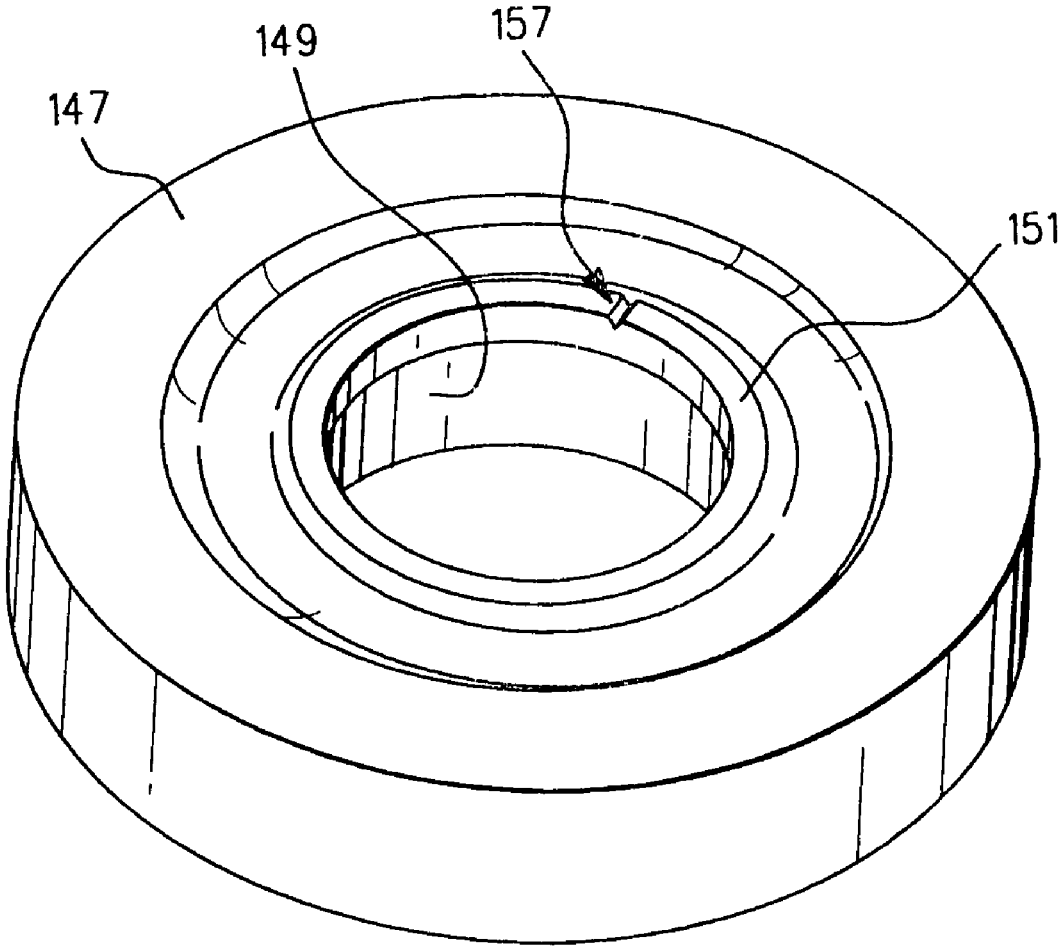
FIG. 5 shows a counterpart plate embodied according to the invention.

In FIG. 5, the counterpart plate 147 is shown enlarged and in perspective. In this view, the bore 149 and the encompassing sealing seat 151 can be seen quite well. A notch 157 is machined into the valve seat 151 and takes over the function of the first throttle restriction 141 of the exemplary embodiments of FIGS. 2 and 3.

Looking at FIGS. 4 and 5 together makes it readily clear that when the first check valve 135 is closed, when the valve member 155 rests on the valve seat 151 of the counterpart plate 147, a hydraulic communication between the pumping chamber 133 and the intake side 103 exists through the notch 157. The notch 157 thus has the function of the first throttle restriction 141 (see FIGS. 2 and 3). Depending on how large the cross section of the notch 157 is, the throttling action of the notch 157 can be adjusted.

It is especially advantageous in this embodiment that the cross section of the notch 157 changes hardly at all over the service life of the first check valve 135, since the contact area of the valve member 155 on the valve seat 151 is relatively large. Moreover, because of the pinch flows that necessarily occur each time the first check valve 135 closes, it is assured that even after many years of operation no contaminants, which can decrease the cross section of the notch 157 or even close the notch 157 completely, can become deposited in the notch 157. As a result, it is assured that the pressure compensation function of the notch 157 is virtually constant over the entire service life of the injection system of the invention. A filter, or other protective devices that are both expensive and vulnerable to malfunction, for the notch 157 are unnecessary. Moreover, compared to the exemplary embodiments of FIGS. 2 and 3, a first bypass line 139 can be omitted.

Figure 6:
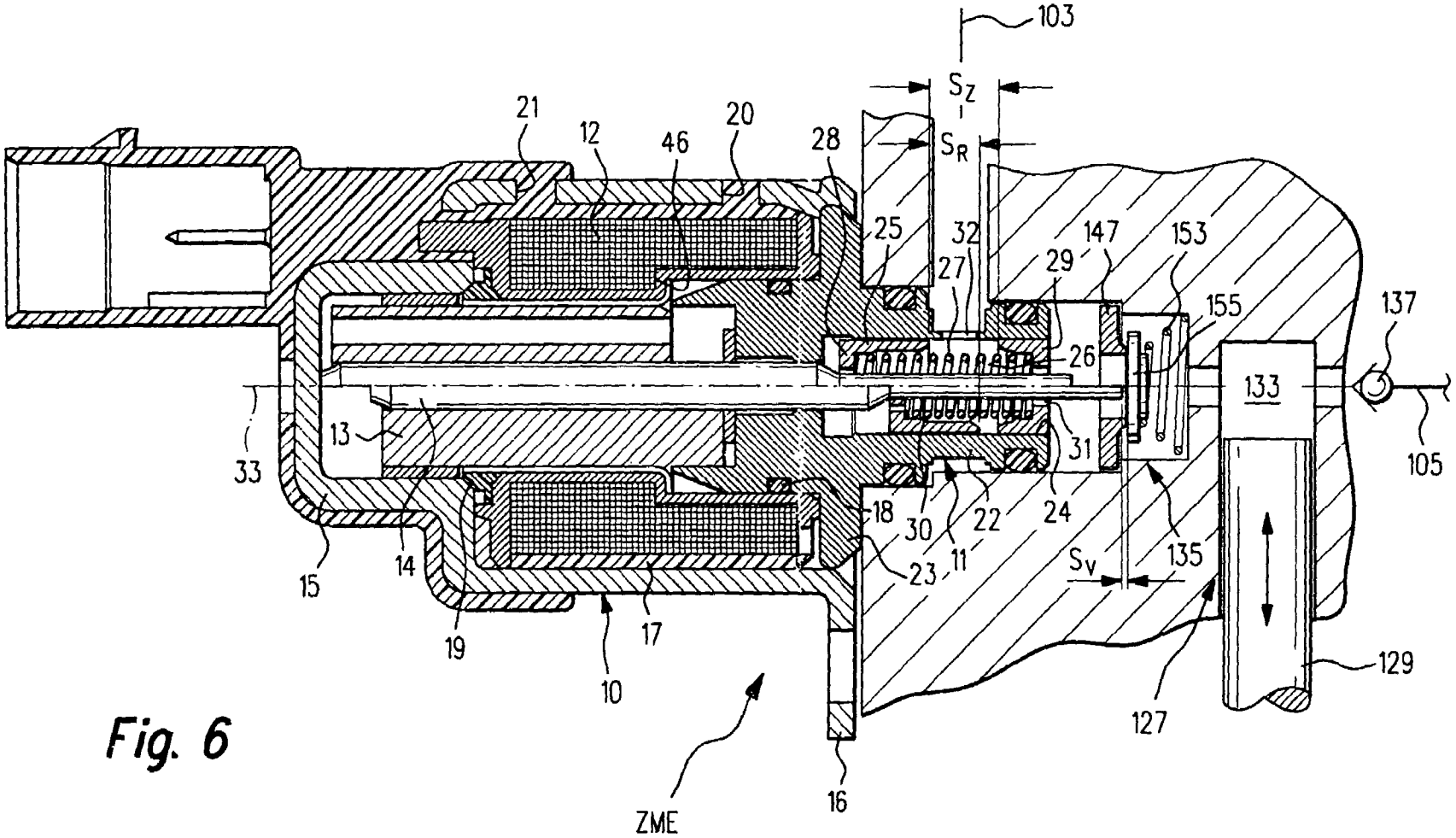

In FIG. 6, a further exemplary embodiment of a high-pressure fuel pump 101 of the invention is shown. In this exemplary embodiment, the first check valve 135 is embodied similarly to the exemplary embodiment of FIG. 4. However, the valve seat 151 in the counterpart plate 147 of the first check valve 135 has no notch 157. This means that the valve member 155 disrupts the hydraulic communication between the interior 26 of the fuel metering unit ZME and the pumping chamber 133 completely as soon as it rests on the valve seat of the counterpart plate 147.

In this exemplary embodiment, the armature bolt 14 is lengthened through both the valve piston 25 and the compression spring 27. The total stroke of the armature bolt 14 is marked $S_Z$ in FIG. 6. In order to open and close the control openings 32 completely, an adjustment distance $S_R$ of the armature bolt 14 is necessary. This adjustment distance $S_R$ is shorter than the total adjustment distance $S_Z$ of the armature bolt 14. When the control openings 32 are completely closed, as is shown in the lower part of FIG. 6, the end of the armature bolt 14 is located in the immediate vicinity of the valve member 155, but without touching it.

If, in engine idling or overrunning, the supply quantity of the piston 129 is now supposed to be less than the leak fuel quantity of the fuel metering unit ZME, then the armature bolt 14 is moved to the right by the armature 13 and the magnet coil 12 far enough that the armature bolt 14 lifts the valve member 155 from the valve seat 151 of the counterpart plate 147, and thus fuel from the pumping chamber 133 can flow back into the fuel metering unit ZME and thus to the intake side 103 during the supply stroke of the piston 129. As a result, the pressure buildup in the pumping chamber 133 is prevented, and no pumping of fuel to the compression side 105 of the high-pressure fuel pump 101 takes place.

The spacing between the armature bolt 14 and the valve member 155 when the control openings 32 are closed is indicated in FIG. 6 by the symbol $S_V$. So that the first check valve 135 can be opened by the armature bolt 14, the total adjustment distance $S_Z$ of the armature bolt 14 must be longer than the adjustment distance $S_R$, required for regulating the supply quantity, plus the spacing $S_V$ between the armature bolt 14 and the valve member 155 when the control openings 32 are closed.

Preferably, the control of the supply quantity of the high-pressure fuel pump 101 is effected in engine idling by varying the supply onset of the pump element. This control is shown in graph form in FIG. 7. In the upper part of FIG. 7, a first line 159 represents the position of the piston 129. The piston 129 moves back and forth between top dead center TDC and bottom dead center BDC. When the piston 129 moves from top dead center to bottom dead center, the volume of the pumping chamber 133 increases, and the so-called intake stroke takes place. In this phase, despite the closed fuel metering unit, or if the fuel metering unit ZME is only slightly open, the piston 129 aspirates fuel from the intake side 103, which unless other provisions in the ensuing supply stroke are taken, in which stroke the piston 129 moves from bottom dead center BDC to top dead center TDC, is pumped into the compression side 105. However, as already noted several times, this is unwanted in some operating states of the engine and is therefore prevented by a suitable triggering of the fuel metering unit ZME.

Figure 7:
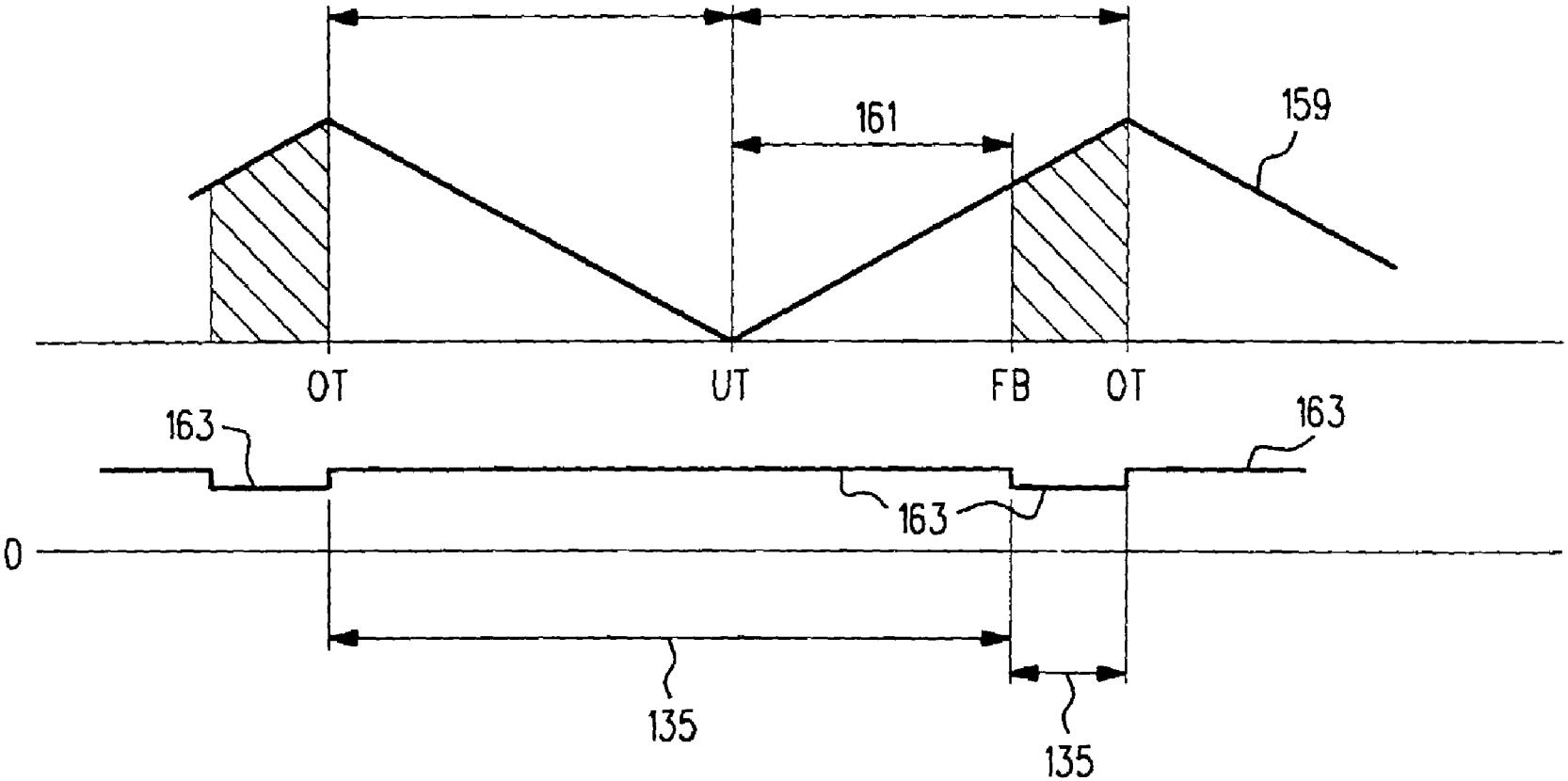
FIG. 7 is a graph, showing the triggering of the fuel metering unit.

In this triggering, the fuel metering unit ZME is triggered such that the first check valve 135 is open from top dead center to bottom dead center and beyond it, until the supply onset FB. This period of time is represented by the double arrow $135_{open}$ in FIG. 7. During the motion of the piston 129 from bottom dead center BDC until the fuel supply onset FB, the leak fuel quantity is forced back into the suction line 103 by the opened first check valve 135. This time interval is represented in FIG. 7 by the double arrow 161. Next, the fuel metering unit ZME is triggered such that the first check valve 135 closes, which is indicated in FIG. 7 by the double arrow $135_{closed}$. In this time interval between the supply onset FB and top dead center TDC, the fuel required for engine idling is pumped to the compression side 105.

In the overrunning mode of the engine, the first check valve remains open during the entire supply stroke (FB=TDC), so that no pumping to the compression side 105 takes place. The control voltage of the fuel metering unit is represented in FIG. 7 by a second line 163.

Figure 8:
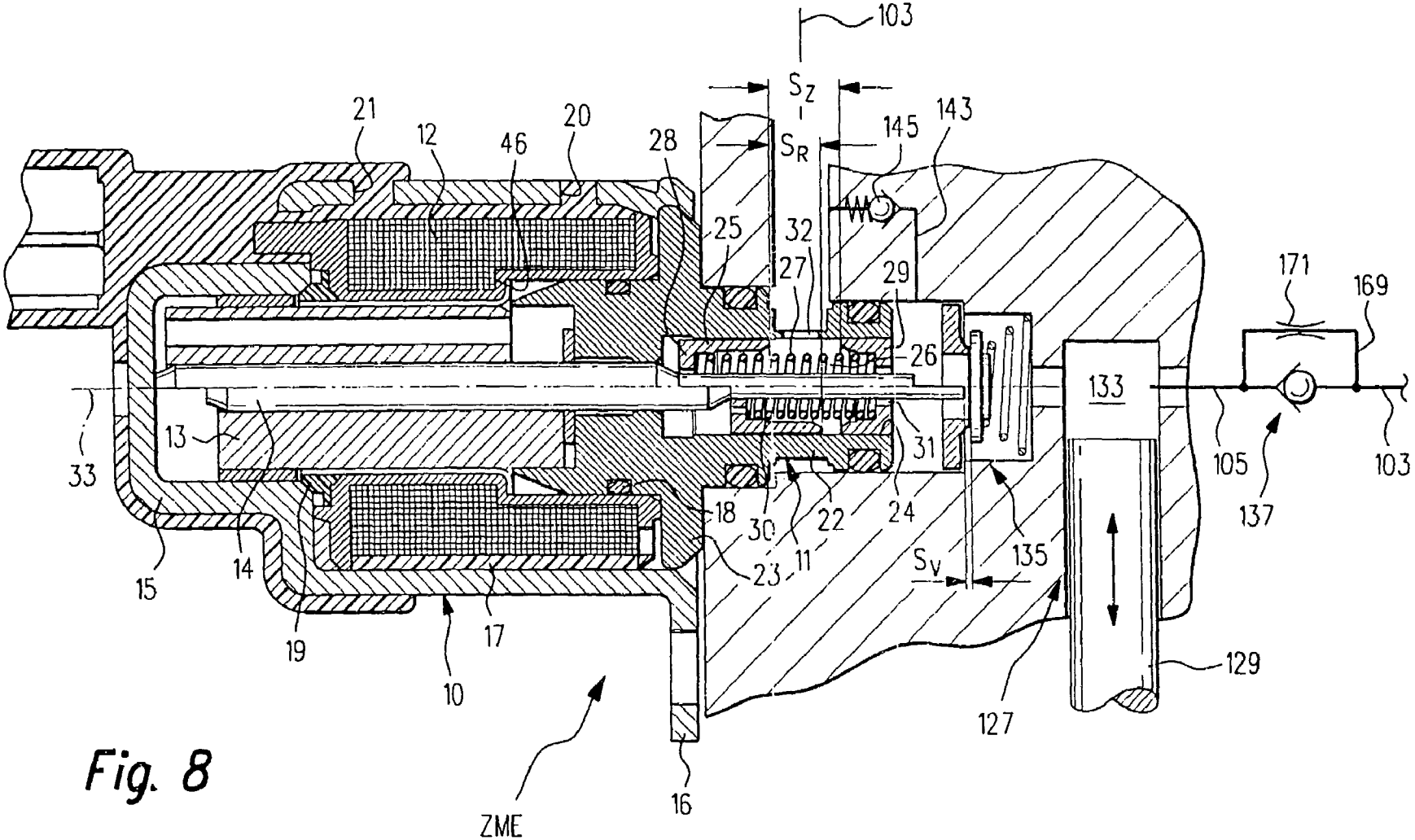
Figure 9:
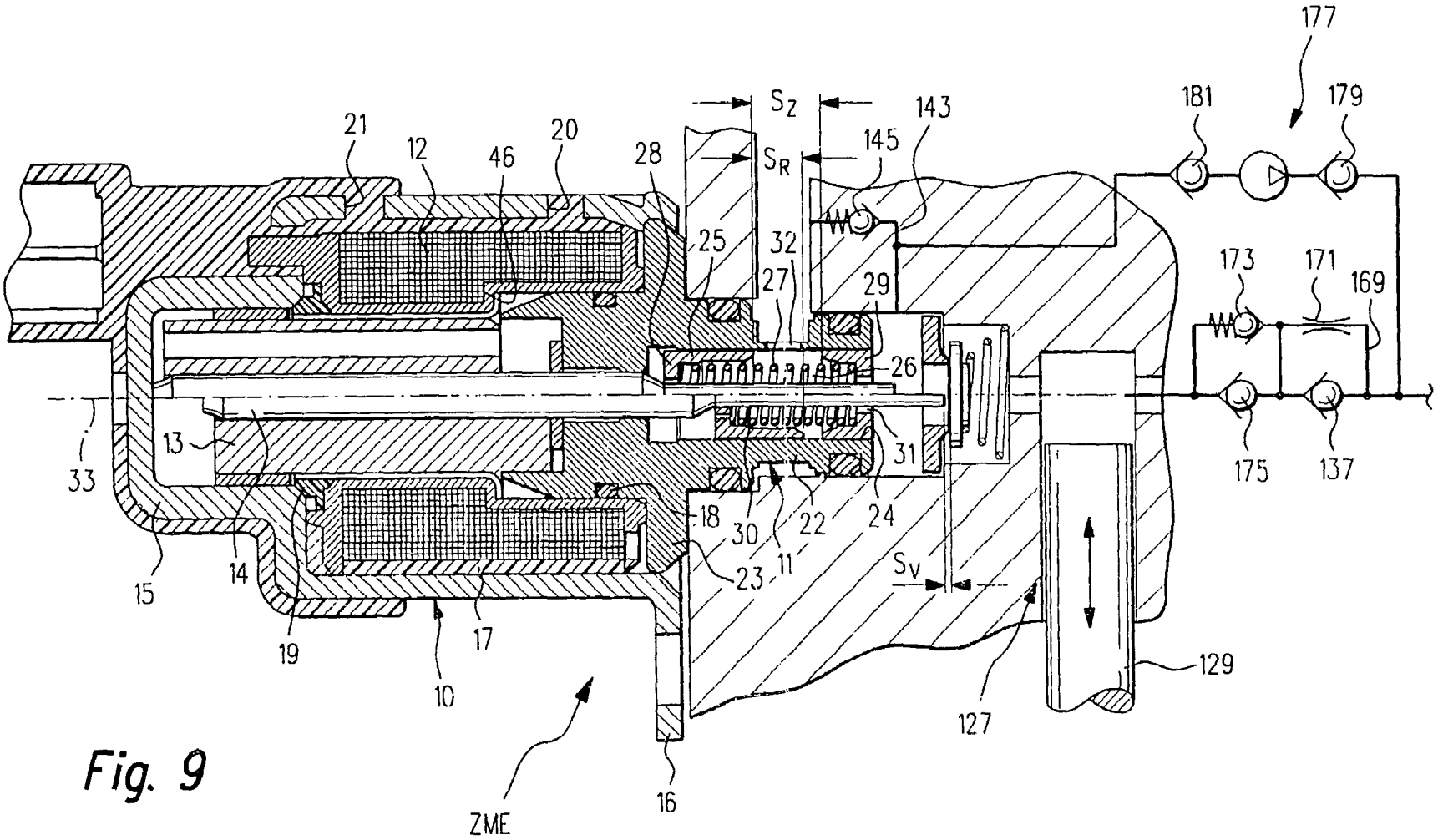

The exemplary embodiments of FIGS. 8 and 9 are based on the exemplary embodiment of FIG. 6 and pertain to provisions for further improving the operating performance of the high-pressure fuel pump 101. For the sake of simplicity, not all the reference numerals are entered in FIGS. 8 and 9. Reference is therefore made to the reference numerals in the preceding drawings.

In the exemplary embodiment of FIG. 8, a third bypass line 169 with a third throttle restriction 171 is provided, which bypasses the second check valve 137 on the compression side 105.

On the compression side 105, in conjunction with the control of the first check valve 135 as described in conjunction with FIG. 6, a targeted pressure reduction can be done in the common rail 107 during overrunning. This is advantageous especially whenever the engine was operated at full load immediately before the overrunning mode, and thus the pressure in the common rail 107 is high. At the end of the overrunning mode, it is in fact desirable for the pressure in the common rail 107 to be relatively low, so that the transition from overrunning to operation under load can be made as gentle and comfortable as possible. To that end, the low pressure in the common rail 107 is helpful, since it makes the accurate, precise metering of extremely small injection quantities easier.

In the exemplary embodiment of FIG. 9, in addition to the second throttle restriction 171, a third pressure limiting valve 173 and a third check valve 175 are provided. The third pressure limiting valve 173 has an opening pressure of 5 to 10 MPa, for instance, which is approximately equivalent to the pressure level in high-pressure starting. The advantage of this variant embodiment is that the pressure reduction function of the second throttle restriction 171 is not operative in high-pressure starting, and thus the volumetric efficiency of the high-pressure fuel pump 101 is improved further. In the exemplary embodiment shown in FIG. 9, the third pressure limiting valve 173 is disposed closer to the pumping chamber 133 than the second throttle restriction 171, which further improves the volumetric efficiency, because of the resultant reduced idle volume. However, the reverse arrangement is readily possible as well.

In FIG. 9, a further pump element 177 with a check valve 181 on the intake side and a check valve 179 on the compression side is shown schematically. This illustration is meant to indicate the fact that the high-pressure fuel pump 101 of the invention is not limited to high-pressure fuel pumps with one pump element 127, but instead a plurality of pump elements 127 and 177 may be present in the high-pressure fuel pump 101. The provisions according to the invention for returning the leakage to the suction line 103 need not, however, be performed for all the pump elements 127 and 177. As a rule, it suffices for one pump element 127 or a first check valve 135 and a second check valve 137 to be embodied according to the invention.

The provisions made on the compression side for improving the operating performance, particularly the second throttle restriction 171, the third pressure limiting valve 173 and the third check valve 175, are not limited to the exemplary embodiments of FIGS. 8 and 9 but instead can be employed in all the exemplary embodiments of the invention described above.

As already known and as can be seen as an example from FIG. 2, the regulating valve 11 is integrated with the magnet cup 15, of the electromagnet 10, and the complete fuel metering unit ZME is screwed directly into the high-pressure fuel pump. As a result, an optimally small installation space and production at favorable cost are guaranteed. The minimal idle volume that is attainable as a result assures exact metering of whatever fuel quantity is required at the time as well as fast reaction times to changing demands for quantity on the part of the high-pressure fuel pump or the engine.

From the above description it is already clear that exact regulatability is important for the valve of a fuel metering device. The triggering of the electromagnet 10 is done with pulse width modulation. This leads to reduced frictional hysteresis and good dynamics for the fuel metering unit.

The foregoing relates to preferred exemplary embodiments of the invention, it being understood that other variants and embodiments thereof are possible within the spirit and scope of the invention, the latter being defined by the appended claims.

We claim:

1. A high-pressure fuel pump for an internal combustion engine, the pump comprising at least one pump element (127) with a pumping chamber (133), for pumping fuel from an intake side (103) to a compression side (105) of the high-pressure fuel pump (101), a device (ZME) on the intake side for controlling the supply quantity of the high-pressure fuel pump (101), a first check valve (135) disposed on the intake side, said first check valve having an inlet and an outlet, and a second check valve (137) disposed on the compression side, wherein the pumping chamber (133) is located hydraulically between the first check valve and the second check valve, and wherein the outlet of the first check valve communicates directly hydraulically with the pumping chamber (133) of the pump element (127), and a relief device operable counter to the flow direction of the first check valve (135) enabling an at least partial pressure equilibrium between the inlet and outlet of the first check valve (135), wherein a fuel metering unit (ZME) serves as the device (ZME) on the intake side for controlling the supply quantity of the high-pressure fuel pump (101); wherein the fuel metering unit has a regulating valve (11), actuated by an electromagnet (10) by means of an armature bolt (14), with a valve piston (25); and wherein the first check valve (135) can be opened by the armature bolt (14).

2. The high-pressure fuel pump in accordance with claim 1, wherein the valve piston (25) is guided in a valve housing (22), and at least one and preferably a plurality of radial control openings (32) are disposed in the wall of the valve housing (22); and wherein the first check valve (135) is not opened by the armature bolt (14) until the control openings (32) are closed.

3. The high-pressure fuel pump in accordance with claim 1, wherein the valve piston (25) is sleevelike in form, and in its interior receives a compression spring (27) that urges the valve piston into the open position; and wherein the compression spring (27) is braced on its back side on a spring plate (29) disposed in a valve bore (24) of the valve housing (22).

4. The high-pressure fuel pump in accordance with claim 2, wherein the valve piston (25) is sleevelike in form, and in its interior receives a compression spring (27) that urges the valve piston into the open position; and wherein the compression spring (27) is braced on its back side on a spring plate (29) disposed in a valve bore (24) of the valve housing (22).

5. The high-pressure fuel pump in accordance with claim 4, wherein the regulating valve (11) is adjustable by suitable axial displacement and ensuing fixation of the spring plate (29) in the valve bore (24).

6. The high-pressure fuel pump in accordance with claim 3, wherein the regulating valve (11) is adjustable by suitable axial displacement and ensuing fixation of the spring plate (29) in the valve bore (24).

7. The high-pressure fuel pump in accordance with claim 2, wherein the valve piston (25) has a turned recess on its cylindrical circumferential surface, and a radial bore communicating with the intake side of the high-pressure fuel pump (101) is disposed in the valve housing (22) in such a way that in the closing position of the valve piston (25), the radial control openings (32) communicate hydraulically, through the turned recess of the valve piston, with the radial bore in the valve housing (22).

8. The high-pressure fuel pump in accordance with claim 4, wherein the valve piston (25) has a turned recess on its cylindrical circumferential surface, and a radial bore communicating with the intake side of the high-pressure fuel pump (101) is disposed in the valve housing (22) in such a way that in the closing position of the valve piston (25), the radial control openings (32) communicate hydraulically, through the turned recess of the valve piston, with the radial bore in the valve housing (22).

9. The high-pressure fuel pump in accordance with claim 3, further comprising an axial sealing seat (51) on an edge, toward the valve piston (25), of the spring plate (29), the sealing seat (51) in the closing position of the valve piston (25) sealingly cooperating with an edge of the valve piston toward the spring plate (29).

10. The high-pressure fuel pump in accordance with claim 1, further comprising a second bypass line (143), connecting the interior (26) of the regulating valve (11) and the intake side (103) of the high-pressure fuel pump (101), and a second pressure limiting valve (145) in the second bypass line (143).

11. The high-pressure fuel pump in accordance with claim 10, further comprising a third bypass line (169), connecting the inlet and outlet of the second check valve (137) disposed on the compression side and a second throttle restriction (171) in the third bypass line (169).

12. The high-pressure fuel pump in accordance with claim 11, further comprising a third pressure limiting valve (173) and a third check valve (175) are connected parallel hydraulically in line with the second throttle restriction (171) and the second check valve (137).

* * * * *